US006244485B1

(12) United States Patent
Holland et al.

(10) Patent No.: US 6,244,485 B1
(45) **Date of Patent: *Jun. 12, 2001**

(54) ARTICLE CARRIER

(75) Inventors: Matthew J. Holland, Baltimore; Brian N. Kagen, Owings Mills, both of MD (US)

(73) Assignee: Black & Decker Inc., Newark, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/289,202

(22) Filed: Apr. 9, 1999

(51) Int. Cl.[7] ..... A45F 5/00

(52) U.S. Cl. ..... 224/584; 224/223; 224/684; 224/236; 224/240; 224/904

(58) Field of Search ..... 224/584, 223, 224/674, 675, 677, 683, 684, 236, 239, 904, 235, 237, 240, 241; D3/220, 224, 225, 228; 206/234, 372, 379; 150/129, 130

(56) References Cited

U.S. PATENT DOCUMENTS

| | | |
|---|---|---|
| D. 236,556 | 8/1975 | Di Paola . |
| D. 239,985 | 5/1976 | Artz . |

(List continued on next page.)

FOREIGN PATENT DOCUMENTS

| | | |
|---|---|---|
| 81 12 879 | 10/1981 | (DE) . |
| 85 01 388 | 4/1985 | (DE) . |
| 87 05 604 | 6/1987 | (DE) . |
| 38 25 195 A1 | 4/1989 | (DE) . |
| 299 01 393 U1 | 5/1999 | (DE) . |
| 0 348 694 B1 | 8/1995 | (EP) . |
| WO 93/02586 | 2/1993 | (WO) . |

OTHER PUBLICATIONS

Camera Case.
Flash Light Case.
Nite Ize® Pock–Its Utility Holster—Website Information (3 pages).
Nite Ize® Mini Pock–Its Utility Holster—Website Information (3 pages).
Nite–Ize Mini Pock–Its Utility Holster and Packaging (6 photographs).
Nite Ize Pock–Its and Packaging (7 photographs).
Duluth Tool Chisel Roll Cotton—Website Information (1 page).
Duluth Wrench Roll—Website Information (1 page).
Duluth Cotton Wrench Roll; DuckWear Tool Roll; and Tool/Chisel Roll—Duluth Trading Co. (catalog p. 34).

*Primary Examiner*—Nathan J. Newhouse
(74) *Attorney, Agent, or Firm*—Harness, Dickey & Pierce, P.L.C.

(57) ABSTRACT

A belt mountable folding pouch-type article carrier or case for small articles such as tool bits and other tool accessories includes a closure panel and article-holding panels, with adjacent panels being separated by end spacer panels. The panels are preferably composed of an outer fabric covering two sides of a flexible inner composite stiffener. The outer material layers are continuous throughout and are stitched together between the panels to form living hinges. The article carrier also includes interior and exterior storage pockets with sides that accommodate varying sizes of articles. The interior of the article carrier includes one or more rows of elastic loops for removably receiving tool bits or other such items. A two-way belt attachment strap structure includes a fixed belt loop with both ends fixedly secured to the the pouch or carrier and a releasable belt loop having one end secured to the pouch and an opposite end releasably securable to the pouch. A user's belt or other external member can be threaded through the fixed belt loop, or the releasable belt loop can be slipped over and around a user's belt while the belt is being worn.

39 Claims, 6 Drawing Sheets

U.S. PATENT DOCUMENTS

| | | | | |
|---|---|---|---|---|
| D. 239,986 | | 5/1976 | Artz . | |
| D. 245,947 | | 10/1977 | Finley . | |
| D. 266,205 | | 9/1982 | Berman . | |
| D. 288,624 | | 3/1987 | Hoard . | |
| D. 291,627 | | 9/1987 | Collins . | |
| D. 292,843 | | 11/1987 | Frezza . | |
| D. 306,654 | | 3/1990 | Brown . | |
| D. 323,937 | | 2/1992 | Solomon . | |
| D. 333,913 | | 3/1993 | Tuman . | |
| D. 348,776 | | 7/1994 | Anderson . | |
| D. 364,038 | | 11/1995 | Stanchin . | |
| D. 368,581 | | 4/1996 | Cincotta . | |
| D. 375,629 | | 11/1996 | Chen . | |
| D. 378,633 | | 4/1997 | Granito . | |
| D. 384,810 | | 10/1997 | Kopel . | |
| D. 387,906 | | 12/1997 | Petty . | |
| 1,506,926 | | 9/1924 | Gunter . | |
| 2,413,580 | | 12/1946 | Perry . | |
| 3,516,585 | | 6/1970 | Inwood . | |
| 3,949,916 | | 4/1976 | Yount . | |
| 3,955,609 | | 5/1976 | Siegel . | |
| 4,047,650 | | 9/1977 | Domingos . | |
| 4,101,025 | | 7/1978 | Jordan . | |
| 4,773,535 | | 9/1988 | Cook . | |
| 4,852,783 | * | 8/1989 | Bryden et al. | 224/674 X |
| 4,921,153 | | 5/1990 | Smith . | |
| 5,002,401 | | 3/1991 | Blackman . | |
| 5,139,143 | | 8/1992 | Pond . | |
| 5,395,023 | * | 3/1995 | Naymark et al. | 224/674 X |
| 5,423,404 | | 6/1995 | Shaw . | |
| 5,711,469 | | 1/1998 | Gormley et al. . | |

* cited by examiner

ARTICLE CARRIER

BACKGROUND AND SUMMARY OF THE INVENTION

The invention relates generally to manually transportable pouches or cases for holding and carrying various articles or items, and more particularly to such portable pouches or cases having pockets, loops or other receptacles for receiving and carrying tool items or accessories, such as tool bits, drill bits, tool chucks, bit holders, or the like.

A wide variety of portfolios, pouches, cases or other such containers or carriers have been devised for holding and organizing tools, tool accessories or other small articles. Many of these carriers have been constructed of flexible fabrics or other materials such that the holder or carrier can be unfolded from a relatively small closed configuration to a larger open configuration, thus providing access to articles removably retained in the holder or carrier.

Frequently, however, such prior art carriers have been found to be lacking in terms of the ease or convenience with which tool bits or other articles are stored or removed by the user. In addition, many of these carriers have been designed for a very specific application or for a narrow range of particular applications and have not been well-suited for use in other applications. Still other carriers have been found to be too large or cumbersome for convenient transportation or use on the person of the user.

A number of the above-mentioned prior art holders or carriers have been provided with belt loops or other such attachment structures that allow them to be mounted onto the person or clothing of the user or to be temporarily mounted or supported by ladder rungs, pipes, railings, or the like. These prior art holders and carriers have not, however, provided for selective alternate methods of attachment to the user's clothing or person or to various external items or structures at the worksite. Because of this, users have been forced to use strings, wires, clips, hooks, or other such separate attaching items in order to obtain a wide range of holding, transporting and mounting capabilities.

Accordingly, the present invention seeks to address these concerns by providing a folding pouch-type carrier or case that is capable of being mounted upon the belt or other item of the user's clothing in more than one way, as well as being conveniently and easily mountable to a wide variety of other external mounting members or structures present at a worksite. The preferred carrier or case is adapted for conveniently holding, storing and transporting small articles such as tool bits, drill bits, driver bits, chucks, bit holders, and other related tools or accessories.

In the preferred embodiments, the carrier includes a closure flap or panel and a number of article-holding panels, with adjacent pairs of panels being separated by relatively narrow upper and lower end spacer panels. All of the panels are preferably composed of a thin, flexible nylon or nylon-type outer fabric or material covering two sides of an inner composite stiffener that is also flexible but is stiffer than the outer fabric. The stiffeners are each in turn composed of a layer of urethane foam padding, a layer of polyethylene, and a layer of polyvinyl chloride in a preferred embodiment. The layers of outer material are continuous from one panel to the next and are preferably stitched together between the spaced-apart stiffeners of adjacent panels to form living hinges along fold lines, thus allowing the pouch or carrier to be easily and conveniently folded into a neat compact closed configuration and to be quickly unfolded into a convenient open configuration for access to its contents.

The upper and lower spacer panels, in a preferred form of the invention, provide a greatly increased interior pouch volume for storing larger or thicker items, as well as presenting a neat, relatively rectangular side profile when the pouch is closed. When mounted on a user's belt or in other similar upright positions, the lower or outer panel folds away (usually merely under the force of gravity) to a convenient open-pouch position as soon as the closure is pulled upward by the user to release the preferred hook-and-loop, snap-type, or other such closure fastener.

The preferred pouch or article carrier also includes both interior and exterior storage pockets with sides that are "accordioned" or easily expandable and contractible in order to accommodate varying sizes of articles stored therein. As such, the storage pockets volumetrically diverge from their "bottom" or closed ends toward their "upper" or open ends and are releasably secured in their closed positions by way of hook-and-loop fasteners, snap-type fasteners, or other such suitable fastening or closure devices. This greatly increases the volume of the pocket interior and accommodates "over stuffing", while still maintaining a minimal pocket side profile when closed. A preferred form of the pouch or article carrier according to the present invention has at least one of such storage pockets exposed for easy and convenient access even when the pouch or article carrier is in its closed configuration.

Preferably the interior of the pouch or article carrier includes one or more rows of elastic loops for removably receiving tool bits or other such items. The preferred tool loops are closed at their "bottom" ends and can elastically expand to accommodate and snugly engage a wide variety of shapes, sizes, and types of tools, tool bits, or other such items. To this end, when more than one such row of elastic loops are provided on a pouch or carrier according to the invention, the loops on one of the rows are preferably larger than those on one or more of the other rows, thus providing for even more flexibility and range of bit holding or article-holding capabilities. In the preferred example disclosed herein, one of such rows of elastic loops and one of the above-described storage pockets are provided on each of the tool-holding or article-holding panels mentioned above, with the loops on one row being laterally staggered with respect to the loops of the other row in order to minimize interference with each other when the pouch is closed.

A two-way belt attachment loop or strap structure is provided on the rear of the preferred pouch or article carrier and includes a fixed loop or strap with both of its ends permanently or fixedly secured to the back of the pouch or carrier. The user's belt can thus be threaded through, or removed from, the fixed belt loop when the belt is removed from the user's body. The preferred pouch or carrier also includes a selective alternative attachment structure with a releasable loop or strap having one end fixedly secured to the back of the pouch and an opposite end releasably securable to the back of the pouch by way of a snap-type or hook-and-loop fastener, for example. The releasable end of this strap can thus be slipped over or around and inside the user's belt while the belt is being worn, as well as being easily and conveniently passed over, around, or through external members or structures present at a worksite. This, of course, provides the user with convenient close-at-hand access to the contents of the pouch or carrier while performing various work tasks.

This two-way selective alternative attachment loop structure in the preferred embodiments of the invention thus accommodates users who need a very secure belt attachment or other such mounting and who anticipate little (if any)

need for removal of the pouch during the work day. The two-way attachment structure also accommodates users who need to remove the pouch several times in a day, allowing them to do so without removing their belts, as well as allowing the pouch to be easily removed from the use's belt and attached to a ladder rung, pipe, railing, or similar structure at the worksite.

Additional objects, advantages and features of the present invention will become apparent from the following description and the appended claims, taken in conjunction with the accompanying drawings.

DETAILED DESCRIPTION OF THE PREFERRED EMBODIMENTS

FIGS. 1 through 12 illustrate exemplary preferred embodiments of a pouch or article carrier according to the present invention. The exemplary pouch or article carrier shown and discussed herein is particularly well-suited and adapted for carrying drill bits, tool bits, driver bits, bit holders, chucks, or other drilling or driving accessories, or even other types of items. Upon reviewing the following discussion in conjunction with the accompanying drawings, one skilled in the art will readily recognize that the present invention is equally applicable to pouches or article carriers of other configurations, as well as those adapted for specific applications other than that of the illustrated embodiments.

Figure 1:
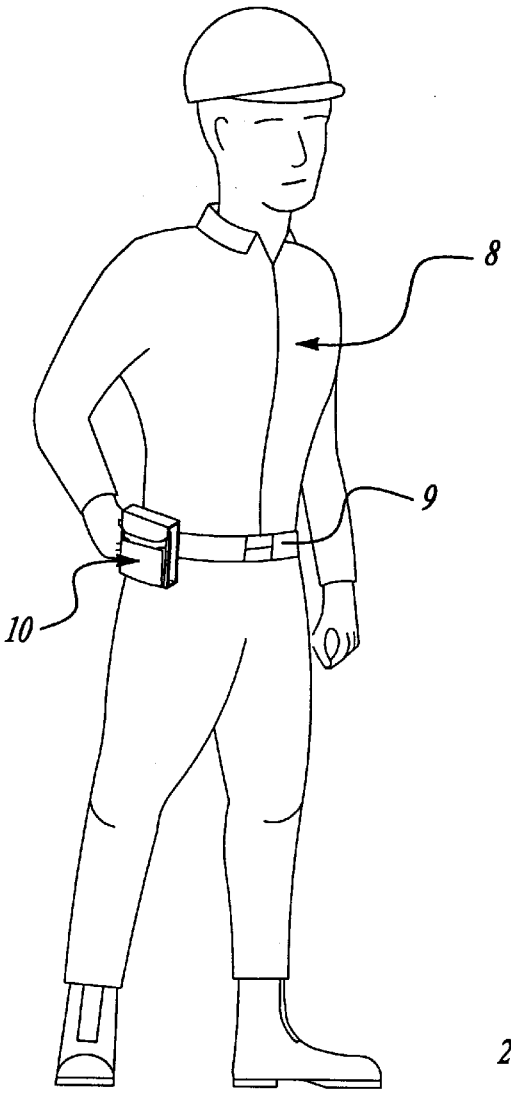
FIG. 1 is perspective view of a pouch or article carrier according to the present invention releasably mounted onto a user's belt or other such item of clothing.
Figure 2:
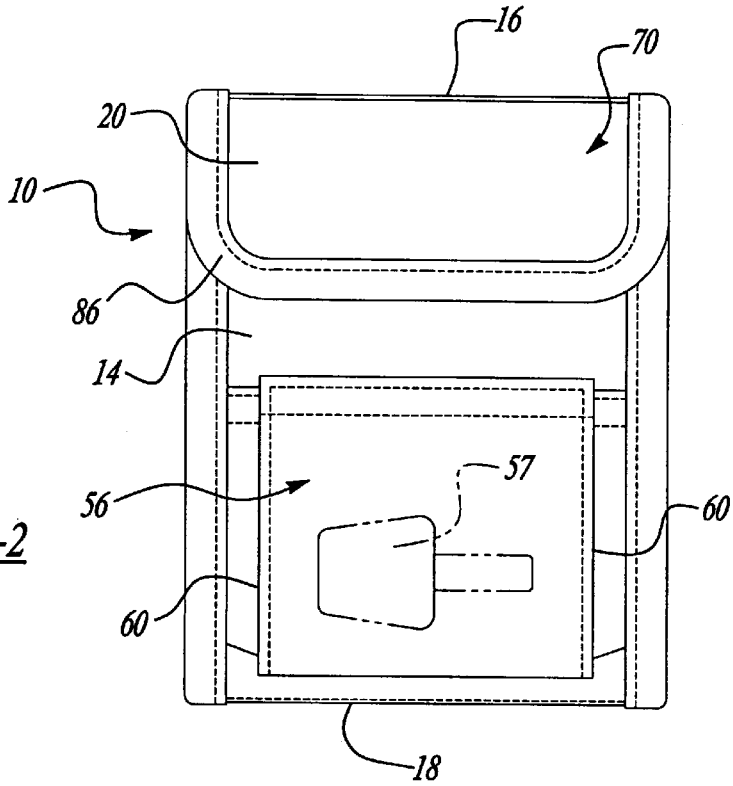
FIG. 2 is a front view of a preferred form of the present invention, shown in its closed configuration.

In FIG. 1 a pouch or article carrier 10 according to the present invention is shown mounted onto a belt 9 worn by a worker or other user 8. Referring initially to FIGS. 1 through 6B, the body of the pouch or article carrier 10 includes an inner article-carrying panel 12, an outer article-carrying panel 14, an upper spacer panel 16, a lower spacer panel 18, and a closure panel 20, all of which interconnect in a foldable configuration allowing the pouch or article carrier 10 to be folded between a closed configuration illustrated in FIGS. 2 and 4 and an open configuration illustrated in FIGS. 3 and 5. A hook-and-loop fastener assembly 22 (or other suitable quick-release fastener) is provided on the inner side of the closure panel 20 and on the outer and upper portion of the outer article-carrying panel 14 in order to allow the pouch 10 to be releasably retained in its closed configuration.

The upper and lower spacer panels 16 and 18 maintain the inner and outer article-carrying panels 12 and 14 in a spaced-apart, generally parallel relationship with each other when the pouch 10 is in its closed configuration. These upper and lower spacer panels 16 and 18 are preferably sized to provide for increased interior pouch volume suitable for storing larger or thicker items, as well as to presenting a neat, relatively rectangular side profile when the pouch 10 is in its closed position. When the pouch 10 is mounted on the belt 9 of the user 8, as shown in FIG. 1, the outer article-carrying panel 14 falls away (by gravity) to the open-pouch configuration when the closure flap 20 is pulled upward and away from the outer article-carrying 14 to release the hook-and-loop or other fastener 22. This rapid-opening feature is enhanced, of course, when tool bits, tool accessories, or other items are removably attached to the outer article-carrying panel 14.

The inner article-carrying panel 12 preferably includes one or more elastic loop rows 24, and similarly the outer article-carrying panel 14 includes one or more elastic loop rows 26 thereon. The loop portions of the elastic loop rows 24 and 26 are preferably closed on their "bottom" ends (when viewed in the open configuration shown in FIG. 3) and thus expand to accommodate a wide variety of bit or tool items shapes, sizes and types, such as the exemplary bits 28 and 30 shown in FIG. 3. To this end, the loops of the elastic loop rows 24 and 26 are preferably staggered with respect to each other, as shown in the cross-sectional view of FIG. 6A, with the loop sizes being the same on the elastic loop rows 24 and 26, or with the loops being larger on one of the rows than on the other in order to provide even more flexibility and range of bit-holding or tool item-holding capabilities.

Figure 6A:
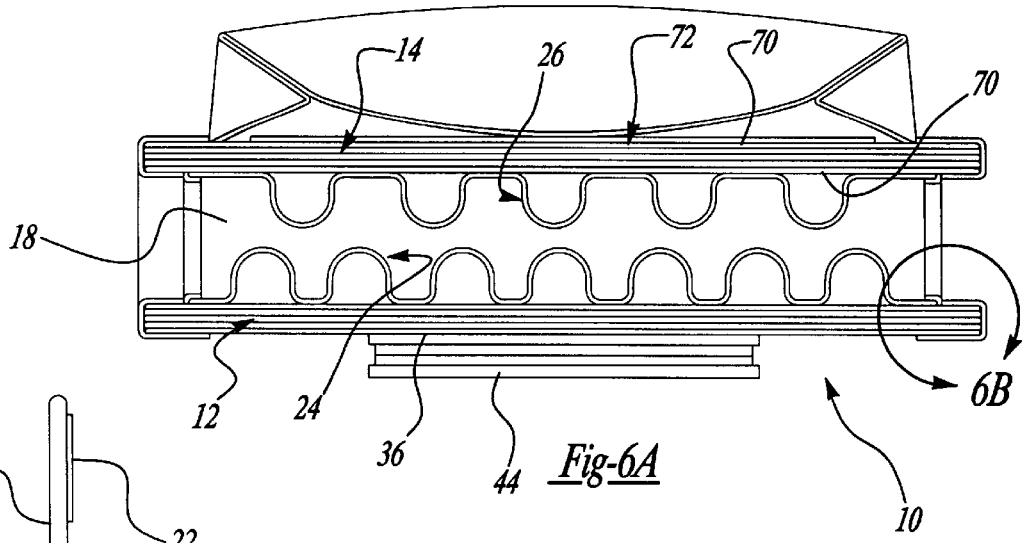
FIG. 6A is a cross-section taken generally through line 6A—6A of FIG. 4.
Figure 5:
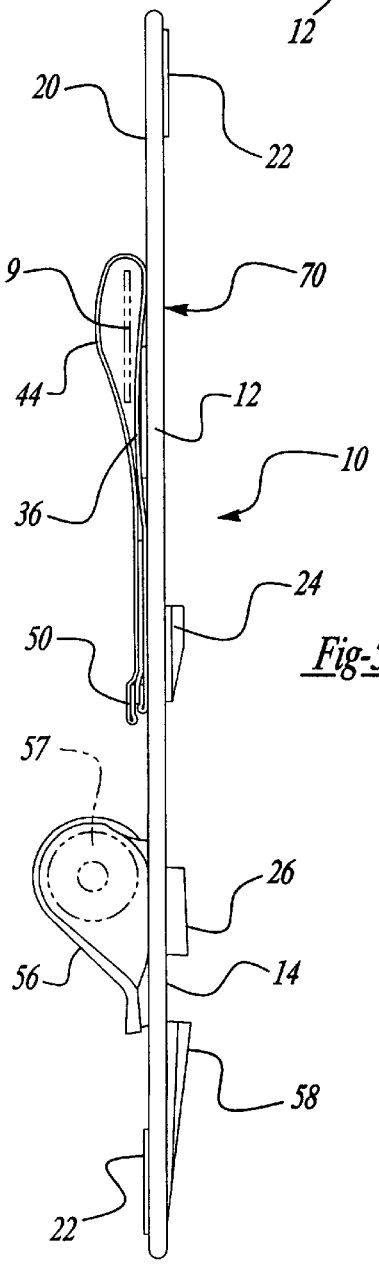
FIG. 5 is a side view similar to that of FIG. 4, but illustrating the pouch or carrier in its open configuration.
Figure 6B:
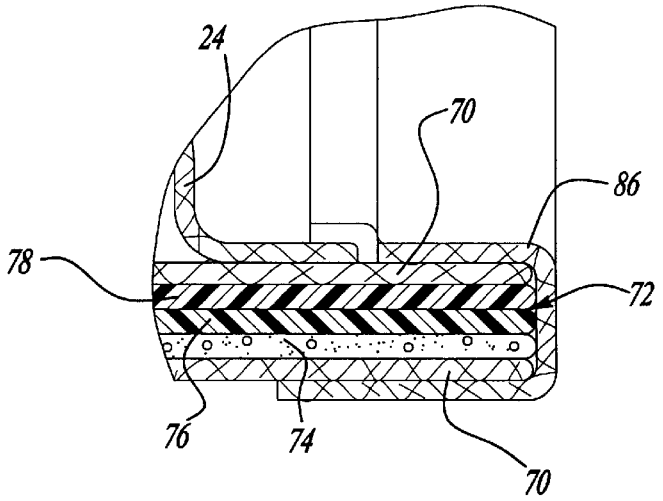
FIG. 6B is an enlarged detail view of the circled portion of FIG. 6A.
Figure 7:
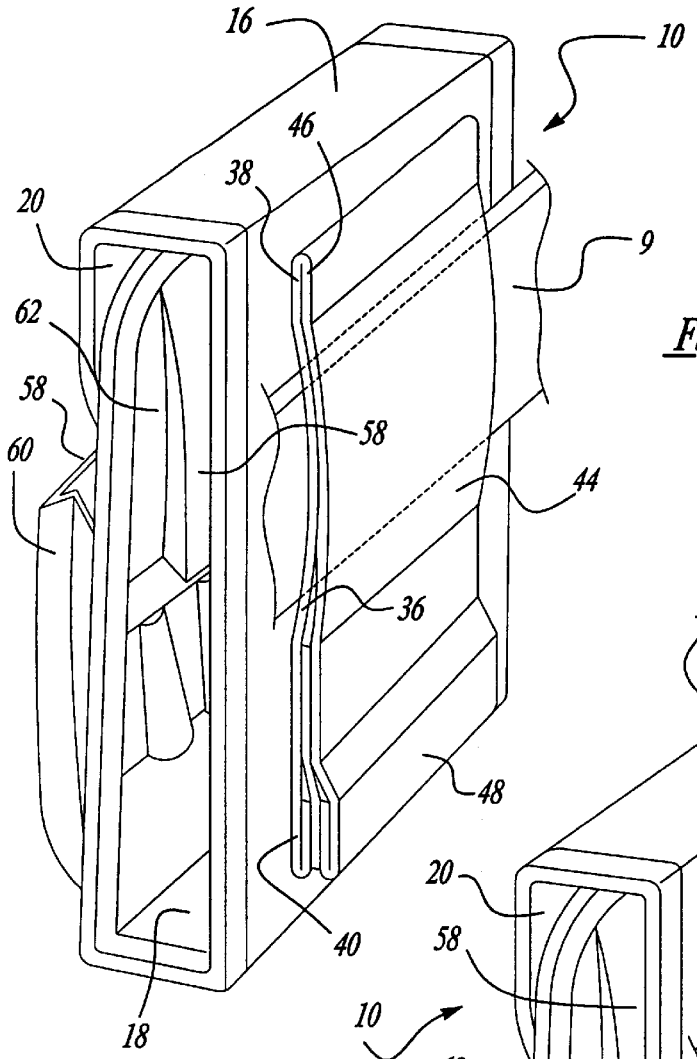
FIG. 7 is perspective view of the rear side of the preferred pouch or article carrier, with a belt or other item being threaded or inserted through a loop created by a fixed attachment strap on the rear of the pouch.
Figure 8:
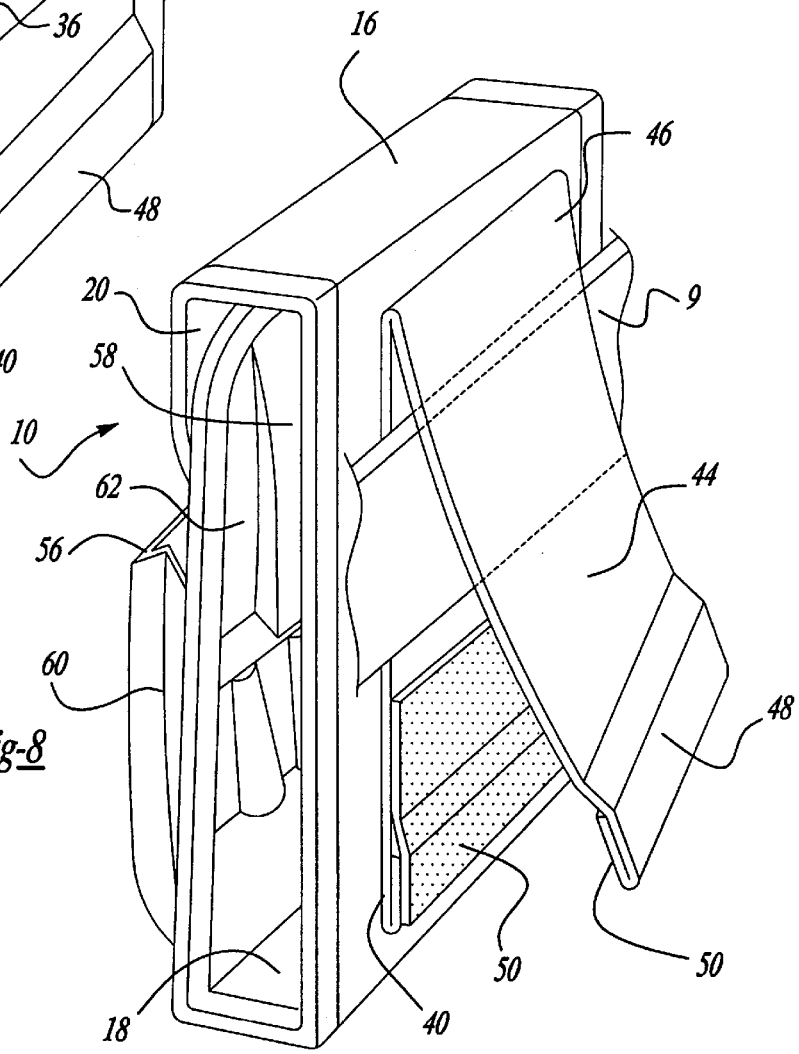
FIG. 8 is a view similar to that of FIG. 7, but illustrating the use of an additional releasable strap being inserted around and behind a belt or similar item on the user's clothing or person.
Figure 12:
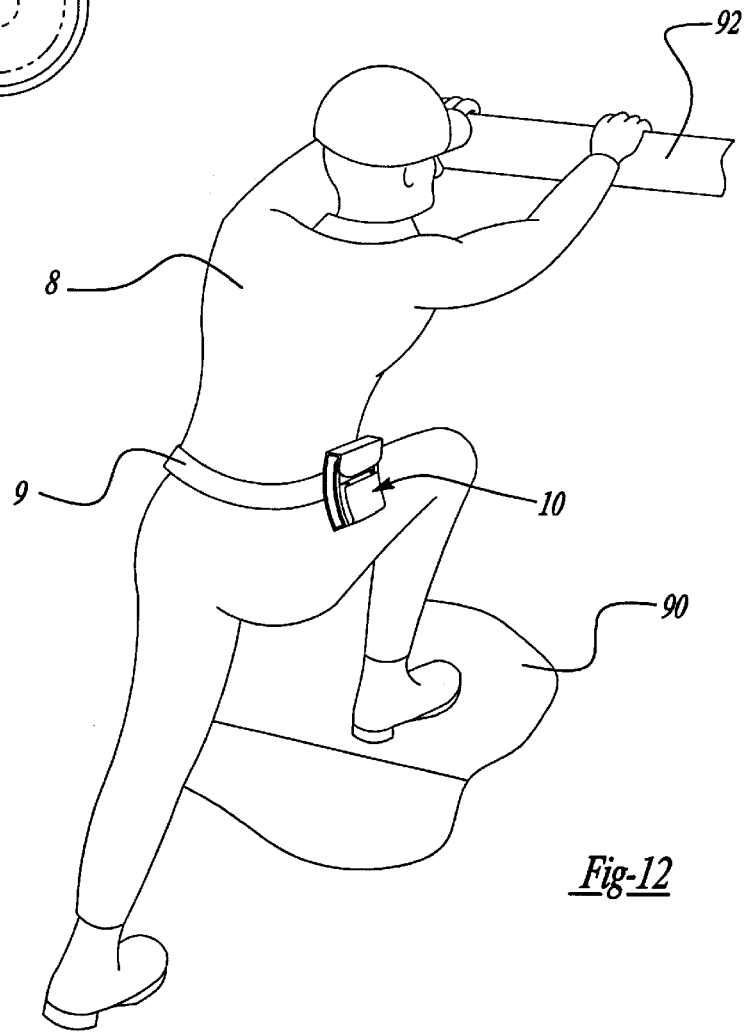
FIG. 12 is a perspective view of a preferred pouch or article carrier, illustrating its flexibility in order to accommodate climbing or other movement of the user.

As can be seen in FIGS. 6A and 6B, the various panel portions of the pouch or article carrier 10 are preferably composed of a pair of relatively thin, highly flexible outer fabric layers 70, between which a number of panel stiffeners 72 are disposed. Preferably the panel stiffeners 72 are also somewhat flexible, but are substantially stiffer than the highly flexible outer fabric layers 70. This provides the pouch or article carrier 10 with sufficient stiffness to maintain its desired shape and to support items stored or being carried therein, while still providing for sufficient flexibility to minimize interference with the movements of the user 8, as is illustrated in FIG. 12, wherein the pouch 10 is shown flexed as the user 8 grasps a ladder rung or railing 92 as he or she steps up onto a step 90.

Preferably, the outer fabric layers 70 are each composed of a nylon, an imitation nylon, or a nylon-type flexible material, which covers both sides of the respective stiffeners 72 of each of the various pouch panels. In turn, the preferred stiffeners 72 are preferably composed of a relatively soft or padded stiffener layer 74 disposed toward the outer side of the stiffener assemblies 72. The stiffeners 72 each also preferably include a pair of stiffener layers 76 and 78, which provide them with the required stiffness, while still maintaining sufficient flexibility to minimize inhibiting effects on user movement. In one preferred embodiment of the pouch or article carrier 10, the stiffener layer 74 was constructed of urethane foam, having a thickness of 0.3 centimeters and a density of 18. In this exemplary preferred embodiment of the pouch or article carrier 10, the stiffener layer 76 was composed of polyethylene and the stiffener layer 78 was composed of polyvinyl chloride, each having a thickness of one millimeter. One skilled in the art will readily recognize, however, that other suitable materials or thicknesses can be substituted for those mentioned above for the stiffener layers 74, 76 and 78 in specific applications.

Figure 3:
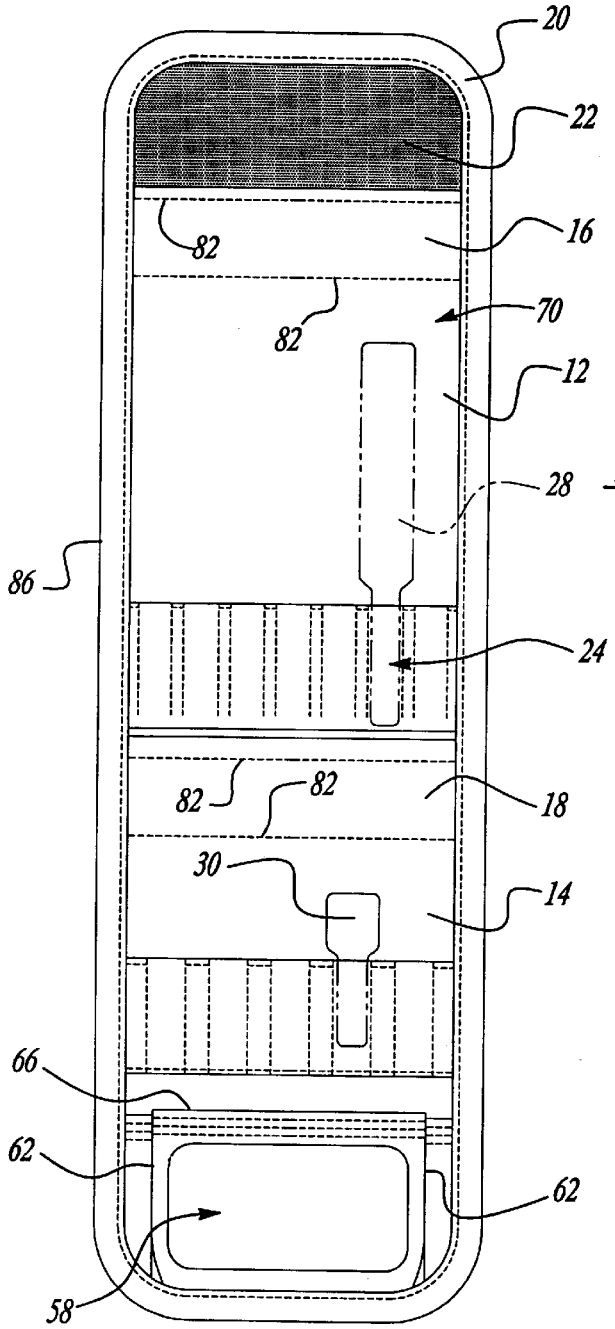
FIG. 3 is a front view, similar to that of FIG. 2, but showing the pouch or article carrier of the present invention in its open configuration.

The outer fabric layers 70 are preferably continuous from one panel to the next throughout each side of the entire pouch or article carrier 10. In contrast, the stiffeners 72 are discontinuous or spaced-apart between adjacent panels, thus allowing the outer fabric layer 70 to be stitched together between the stiffeners 72 of these adjacent panels in order to form living hinges along the fold lines, thus allowing the pouch or article carrier 10 to be folded into and out of its closed configuration. Such stitched fold lines or living hinges 82 are perhaps best seen in FIG. 3. Finally, in order to provide a neat appearance and increased durability, the edge of the pouch or article carrier 10 is banded by edging fabric 86, as shown in FIG. 3, with the edging fabric 86 also being composed of nylon, imitation nylon, or other suitable and durable nylon-type fabric materials.

Referring primarily to FIGS. 1 and 4 through 8, the pouch or article carrier 10 preferably includes a unique two-way attachment arrangement for removably attaching or mounting the pouch 10 to the belt 9 of a user 8 or to allow the pouch 10 to be attached or mounted onto other external mounting members, such as ladder rungs, pipes, handrails, poles, ropes, cables, or the like at a worksite. This two-way belt attachment arrangement is disposed on the rear or outer side of the inner article-carrying panel 12 includes a fixed attachment or mounting strap 36 with its upper and lower ends 38 and 40 each fixedly secured to the inner article-carrying panel 12. This provides for an opening between the upper and lower ends 38, through which the user's belt 9 or other such external item can be removably and threadably inserted in order to mount the pouch 10 thereto.

Similarly, the pouch 10 preferably also includes a releasable attachment strap 44 on the rear side of the inner article-carrying panel 12, with its upper fixed end 46 being fixedly secured to the article-carrying panel 12, and its lower releasable end 48 being free to be removed or releasably attached to the rear side of the article-carrying panel 12 by way of a hook-and-loop fastener 50, a snap-type fastener, or other suitable quick-releasable fastener types known to those skilled in the art. By way of this construction, the releasable attachment strap 44 can be moved around, behind, or through external mounting members, such as the user's belt 9, prior to attaching its releasable attachment strap 44 to the rear side of the article-carrying panel 12.

In this way, the pouch 10 accommodates users who desire a very secure mounting of the pouch 10 to a belt 9 or other external mounting member, by way of the fixed attachment strap 36, in situations where the user anticipates infrequent need for removal of the pouch 10 during the workday. In addition, by way of the releasable attachment strap 44, the pouch can be easily mounted and demounted several times in a day without the necessity of removing the user's belt 9 or otherwise disturbing the external mounting member to which the pouch 10 is releasably mounted. Preferably both the fixed attachment strap 36 and the releasable strap 44 are sufficiently long to accommodate wider belts or larger external mounting members. As shown in the drawings, the straps 36 and 44 can be continuous with each other, with the strap 44 overlying the strap 36.

Figure 9:
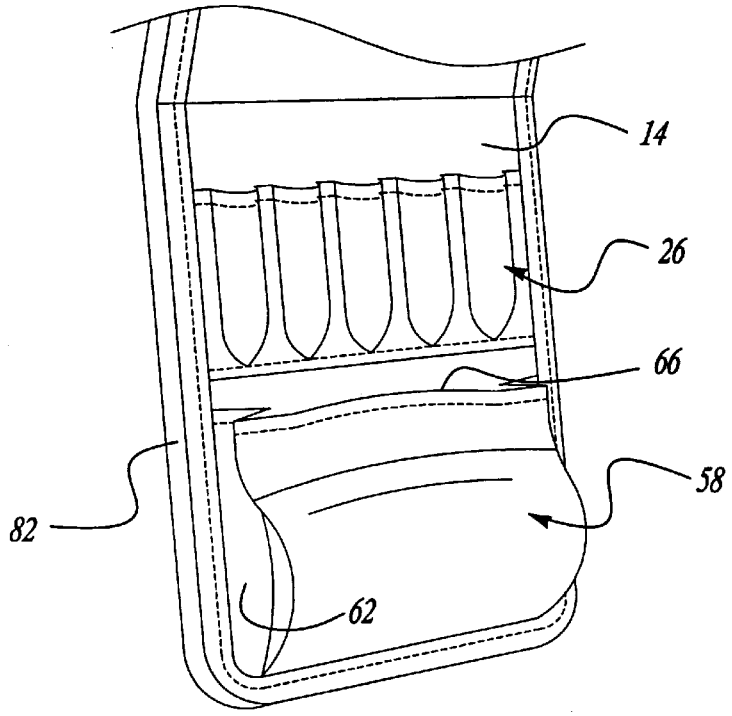
FIG. 9 is a detailed perspective of an inner pocket on the preferred pouch or article carrier, illustrating the expandable and contractible nature of the pocket sides.
Figure 10:
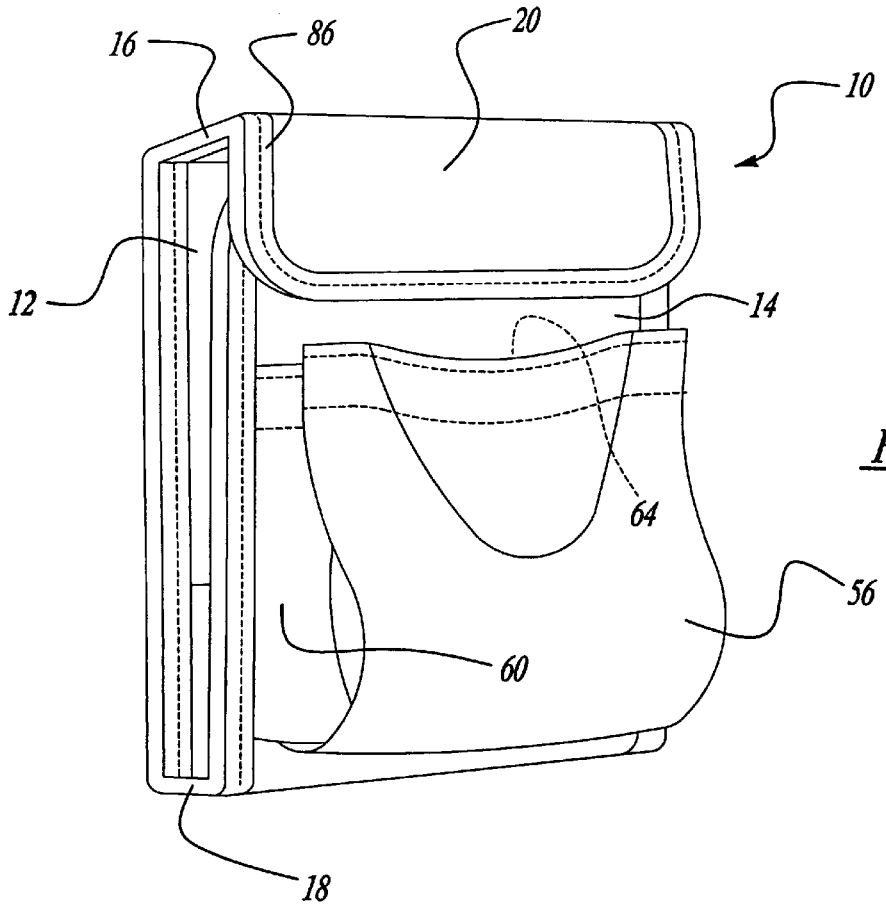
FIG. 10 is a view similar to that of FIG. 9, but illustrating an outer storage pocket of the preferred pouch or article carrier.

The pouch or article carrier 10 also preferably includes an outer storage pocket 56, preferably disposed on the outer side of the outer article-carrying panel, "below" the hook-and-loop fastener 22. This outer storage pocket 56 is conveniently sized and located for quick and easy access to a chuck, bit holder, or other tool accessories. Similarly, in preferred embodiments of the pouch or article carrier 10, an inner storage pocket 58 is provided on the inner side of the outer article-carrying panel 14, and is also sized and located for convenient access to a wide variety of tools, tool bits, or similar accessories. As shown in FIGS. 9 and 10, the outer and inner storage pockets 56 and 58 have "accordioned" expandable and contractible sides 60 and 62, respectively, which allow the storage pockets 56 and 58 to volumetrically diverge from their "bottom" or closed ends toward to their "upper" or open ends. The outer and inner storage pockets 56 can be releasably secured in closed positions by way of closure fasteners 64 and 66. Such closure fasteners 64 and 66 can be hook-and-loop fasteners, snap-type fasteners, or other such suitable quick-release fasteners known to those skilled in the art.

Figure 4:
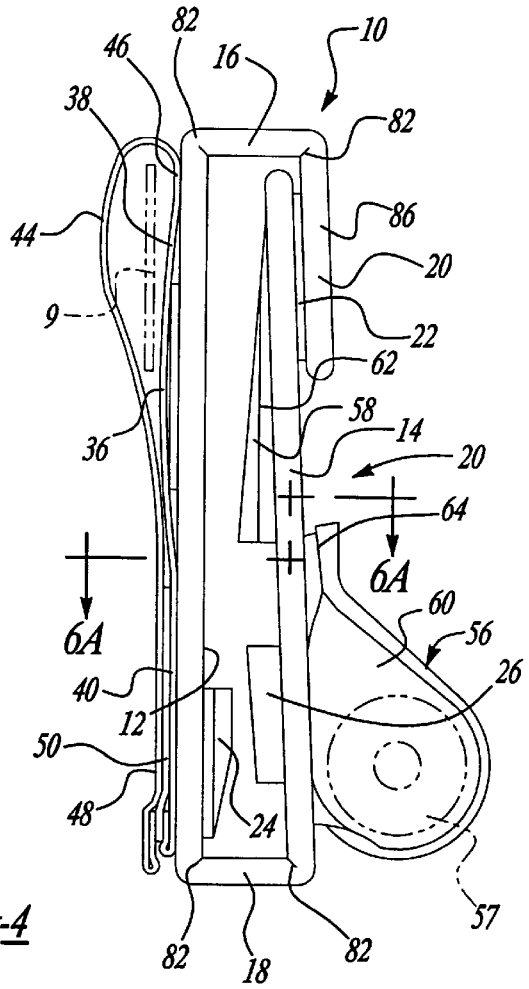
FIG. 4 is a side view of the exemplary pouch or article carrier in its closed configuration.
Figure 11:
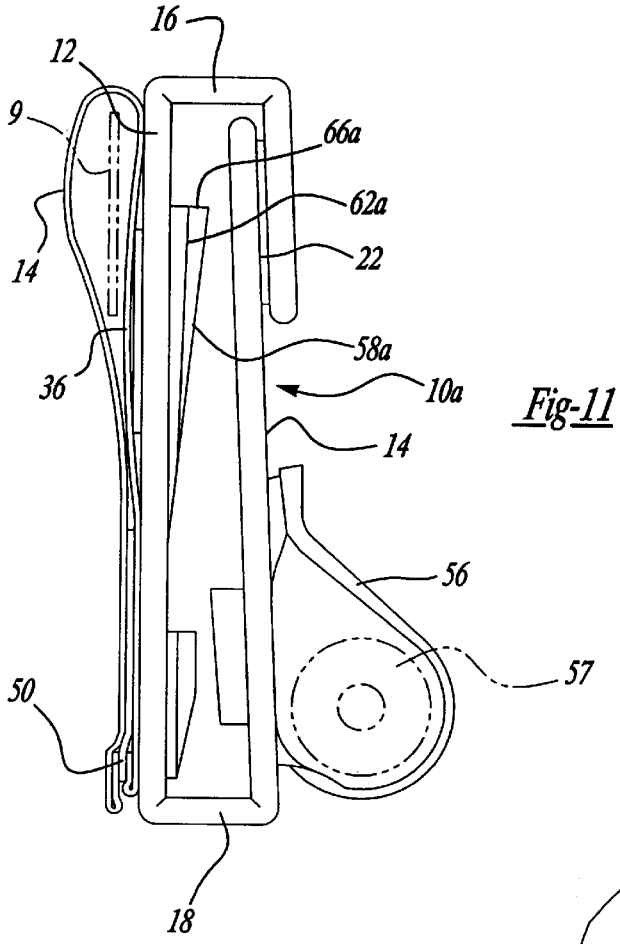
FIG. 11 illustrates a somewhat modified alternate embodiment of a pouch or article carrier according to the present invention, wherein the inner and outer storage pockets are disposed on different item-holding panels.

Although the outer and inner storage pockets 56 and 58, respectively, are located on opposite sides of the same outer article-carrying panel 14 in the preferred embodiment illustrated in side view in FIG. 4, an alternate construction can also be employed, as illustrated in FIG. 11. In FIG. 11, the inner storage pocket 58*a* is disposed on the outer side of the inner article-carrying panel 12 (rather than on the inner side of the outer article-carrying panel 14 of FIG. 4). In any of the embodiments, such as those depicted in FIGS. 4 and 11, the "accordioned" expandable and contractible sides 60 and 62 of the outer and inner storage pockets 56 and 58, respectively, provide for an increased pocket interior volume and thus accommodate over stuffing, while still maintaining a minimal profile or thickness when closed. In one preferred example of a pouch or article carrier 10 according to the present invention, the external storage pocket 56 was sized somewhat larger than the inner storage pocket 58 in order to preserve the neat, generally rectangular side profile of the pouch or article carrier 10.

The foregoing discussion discloses and describes merely exemplary embodiments of the present invention for purposes of illustration only. One skilled in the art will readily recognize from such discussion, and from the accompanying drawings and claims, that various changes, modifications, and variations can be made therein without departing from the spirit and scope of the invention as defined in the following claims.

What is claimed is:

1. An article carrier adapted to be releasably mounted onto an external mounting member, said article carrier including a body portion to which at least one article is releasably securable, said article carrier further including:

an elongated first attachment member fixedly secured to said carrier body at a pair of spaced-apart first and second attachment locations thereon in order to define a closed loop therebetween through which said external mounting member can be inserted;

an elongated second attachment member fixedly secured to said carrier body at a third attachment location thereon and releasably securable to said carrier body at a fourth attachment location spaced apart from said third attachment location thereon in order to define a second loop therebetween through which said external mounting member can be inserted when said second attachment member is releasably secured to said carrier body at said fourth attachment location, a portion of said second attachment member being freely movable when released from said carrier body at said fourth attachment location in order to be movable around a portion of said external mounting member prior to being releasably secured to said carrier body at said fourth attachment location; and at least a pair of panels foldably interconnected with one another so that said panels can be folded between a closed configuration and an open configuration, each of said panels having an inner and an outer layer of flexible material and a stiffener between said inner and outer layers, said stiffener also being flexible but being substantially stiffer than said flexible inner and outer layers, each of said panels further having a layer of padding between said outer layer and said stiffener, said inner and outer layers being continuous from one panel to an adjacent panel and said stiffeners being discontinuous from said one panel to said adjacent panel in order to form a foldable hinge therebetween, said inner and outer layers being secured to each other along said foldable hinge.

2. An article carrier according to claim 1, wherein said third attachment location is generally adjacent one of said first and second attachment location on said carrier body, said fourth attachment location being generally adjacent the other of said first and second attachment location.

3. An article carrier according to claim 1, wherein said third attachment location is substantially coincident with one of said first and second attachment locations on said carrier body.

4. An article carrier according to claim 3, wherein said fourth attachment location is substantially coincident with the other of said first and second attachment locations in said carrier body.

5. An article carrier according to claim 1, wherein said second attachment member is fixedly secured at one end to said carrier body at said third attachment location thereon and is releasably securable at an opposite end to said carrier body at said fourth attachment location thereon.

6. An article carrier according to claim 1, wherein a portion of said second attachment member is releasably securable to said carrier body by a hook-and-loop fastener.

7. An article carrier according to claim 1, wherein a portion of said second attachment member is releasably securable to said carrier body by a snap-type fastener.

8. An article carrier according to claim 1, wherein said first and second attachment members are flexible respective first and second attachment straps, said second attachment strap overlying said first attachment strap when releasably secured to said carrier body with said first attachment strap being generally between said second attachment strap and said carrier body.

9. An article carrier according to claim 1, wherein said external mounting member is a belt adapted to be worn on a user's body.

10. An article carrier according to claim 1, wherein said external mounting member is any one of a group of external mounting members including a ladder rung, a pipe, a handrail, a pole, a rope, and a cable.

11. An article carrier adapted for holding and carrying an article, said article carrier including a first substantially flat body panel to which at least one article is releasably securable onto an article-carrying side thereof, a second substantially flat body panel to which at least one article is releasably securable onto an article-carrying side thereof, a first substantially flat spacer panel disposed between said first and second said body panels, said first spacer panel and said first and second body panels being foldably interconnected in order to allow selective movement of said first and second body panels relative to said spacer panel into a closed position wherein said article-carrying sides face each other and wherein said first and second body panels are substantially flat and parallel to each other and spaced apart a predetermined distance defined by said first spacer panel, said carrier further including a substantially flat closure panel and a second substantially flat spacer panel disposed between said first body panel and said closure panel, said first body panel, said second spacer panel and said closure panel being foldably interconnected in order to allow said closure panel to be folded over said second body panel and releasably secured thereto when said first and second body panels are in said closed position, said first and second spacer panels having substantially equal widths in order to maintain said first and second body panels in the said substantially flat and parallel spaced-apart relationship when in said closed position, said first and second body panels and said spacer panels each being reinforced by an internal stiffener disposed between inner and outer layers of material, said internal stiffener being substantially less flexible than said inner and outer layers of material, said stiffeners on each pair of adjacent panels being spaced apart in order to form a foldable hinge therebetween.

12. An article carrier according to claim 11, wherein said closure panel is releasably securable by a hook and loop fastener.

13. An article carrier according to claim 11, further including at least one belt attachment strap on an opposite side of first body panel from article-carrying side for removably mounting said carrier onto an external member.

14. An article carrier according to claim 11, further including a releasably closable exterior pocket on an opposite side of second body panel from said article-carrying side.

15. An article carrier according to claim 14, further including a releasably closable interior pocket on said article-carrying side of second body panel.

16. An article carrier according to claim 14, further including a releasably closable pocket on said article-carrying side of said first body panel.

17. An article carrier according to claim 1, wherein said first and second body panels each have a row of elastic loops thereon into which articles can be removably inserted.

18. An article carrier according to claim 17, wherein said elastic loops on one of said body panels are larger in diameter than those on the other of said body panel.

19. An article carrier according to claim 11, further including a row of elastic loops on said article-carrying side of each of said first and second body panels into which loops articles can be releasably inserted, said second body panel having a releasably closable pocket on each side thereof.

20. An article carrier including at least a pair of substantially flat body panels foldably interconnected with one another so that said body panels can be folded between a substantially flat and generally parallel closed configuration defining a carrier interior therebetween and any of a number of open configurations in which said body panels are not parallel to each other, said body panels being foldably interconnected to opposite sides of a substantially flat spacer panel said spacer panel maintaining said body panels in said substantially flat and generally parallel relationship when in said closed position at least one of said body panels having an interior storage pocket thereon, said interior storage pocket being disposed generally within said carrier interior when said body panels are in said closed configuration, at least one of said body panels having an outer storage pocket disposed on the exterior of said article carrier when said body panels are in said closed configuration, said interior and outer storage pockets each being releasably closable in order to retain articles removably stored therein when said body panels are in either of said closed and open configurations, and each of said inner and outer storage pockets having a portion thereof that is expandable and collapsible in order to allow said storage pockets to accommodate articles of varying sizes being removably stored therein.

21. An article carrier according to claim 20, wherein said storage pockets are each releasably closable by hook-and-loop fasteners.

22. An article carrier according to claim 20, wherein said inner and outer storage pockets are disposed on opposite sides of the same body panel.

23. An article carrier according to claim 20, wherein said inner storage pocket is on one of said body panels and said outer storage pocket is on the other of said body panels.

24. An article carrier according to claim 20, further including an attachment strap thereon to allow said carrier to be removably mounted onto an external mounting member.

25. An article carrier according to claim 24, wherein said attachment strap is a belt loop and said external mounting member is a belt adapted to be worn on a user's body.

26. An article carrier according to claim 20, wherein each of said body panels has a row of elastic loops thereon into which articles can be removably inserted, said rows of elastic loops facing each other when said body panels are in said closed configuration.

27. An article carrier according to claim 20, further including a substantially flat spacer panel disposed between said body panels and being foldably interconnected with said substantially flat body panels, said spacer panel maintaining said body panels in a predetermined spaced-apart relationship when in said closed configuration.

28. An article carrier according to claim 27, wherein said carrier includes a pair of said substantially flat spacer panels disposed at opposite ends of one of said body panels in order to maintain said body panels in a substantially flat generally parallel predetermined spaced-apart relationship when in said closed configuration.

29. An article carrier according to claim 20, wherein said body panels and said spacer panel each include an inner and an outer layer of material and are each reinforced by an internal stiffener between said inner and outer layers of material, said internal stiffeners being substantially stiffer than said inner and outer layers of material.

30. An article carrier including at least a pair of panels foldably interconnected with one another so that said panels can be folded between a closed configuration and an open configuration, each of said panels having an inner and an outer layer of flexible material and a stiffener between said inner and outer layers, said stiffener also being flexible but being substantially stiffer than said flexible inner and outer layers, each of said panels further having a layer of padding between said outer layer and said stiffener, said inner and outer layers being continuous from one panel to an adjacent panel and said stiffeners being discontinuous from said one panel to said adjacent panel in order to form a foldable hinge therebetween, said inner and outer layers being secured to each other along said foldable hinge.

31. An article carrier according to claim 30, wherein said stiffener is a composite of two or more layers of stiffening material.

32. An article carrier according to claim 31, wherein one of said layers of stiffening material is a polyethylene and another of said layers of stiffening material is a polyvinyl chloride.

33. An article carrier according to claim 32, wherein said layer of padding is composed of a urethane foam material.

34. An article carrier according to claim 33, wherein at least one of said inner and outer layers is a nylon material.

35. An article carrier according to claim 30, wherein at least two of said panels have an article-carrying structure thereon for removably receiving and securing one or more articles thereon.

36. An article carrier according to claim 35, wherein said panels are generally parallel with each other with said article-carrying structures on said panels generally facing each other when said panels are in said closed configuration, said panels being releasably securable in said closed configuration.

37. An article carrier according to claim 36, wherein said article-carrying structures include a row of elastic loops on each of said panels adapted to removably receive articles therein.

38. An article carrier according to claim 37, wherein said article-carrying structures further include at least one releasably closable storage pocket on at least one of said panels.

39. An article carrier according to claim 38, wherein said article-carrying structures include at least two of said storage pockets, one of said storage pockets being disposed between said panels in an interior of said carrier when in said closed configuration, and the other of said storage panels being disposed on an exterior of said carrier when in said closed configuration.

* * * * *

UNITED STATES PATENT AND TRADEMARK OFFICE

CERTIFICATE OF CORRECTION

PATENT NO. : 6,244,485 B1
DATED : June 12, 2001
INVENTOR(S) : Matthew J. Holland et al.

It is certified that error appears in the above-identified patent and that said Letters Patent is hereby corrected as shown below:

Column 8,
Line 49, "claim 1" should be -- claim 11 --.

Signed and Sealed this

Twenty-ninth Day of April, 2003

JAMES E. ROGAN
*Director of the United States Patent and Trademark Office*